US005992058A

United States Patent [19]

Jneid

[11] Patent Number: 5,992,058

[45] Date of Patent: Nov. 30, 1999

[54] DETACHABLE SHOE STRAP SYSTEM

[76] Inventor: Hudson Jneid, P.O. Box N81 Petersham, North New South Wales 2049, Australia

[21] Appl. No.: 09/054,244

[22] Filed: Apr. 2, 1998

[51] Int. Cl.[6] ..... A43B 3/12; A43B 3/24

[52] U.S. Cl. ..... 36/100; 36/11.5; 36/101

[58] Field of Search ..... 36/11.5, 97, 100, 36/101, 106, 7.1 R, 36 R, 36 B, 36 C

[56] References Cited

U.S. PATENT DOCUMENTS

| | | |
|---|---|---|
| D. 270,680 | 9/1983 | Jansson . |
| 3,925,915 | 12/1975 | Colli . |
| 4,713,895 | 12/1987 | Valieres . |
| 4,887,369 | 12/1989 | Bailey et al. . |
| 5,133,138 | 7/1992 | Durcho . |
| 5,337,491 | 8/1994 | Mascotte . |
| 5,544,430 | 8/1996 | Jacko . |
| 5,581,910 | 12/1996 | Lewis . |
| 5,836,090 | 11/1998 | Smith . |
| 5,852,885 | 12/1998 | Ferniani . |

FOREIGN PATENT DOCUMENTS

| | | | |
|---|---|---|---|
| 948271 | of 0000 | France | 36/100 |
| 2523299 | 12/1976 | Germany | 36/101 |

*Primary Examiner*—Paul T. Sewell
*Assistant Examiner*—Anthony Stashick

[57] ABSTRACT

A new detachable shoe strap system for providing an assortment of easily interchangeable styles of footwear in a single system. The inventive device includes a sole member having upper and lower surfaces, and a perimeter side wall extending around the perimeter of the sole member between the upper and lower surfaces of the sole member. A heel is detachably coupled to the lower surface of the sole member and is located towards the heel end of the sole member. The system includes a plurality of flexible straps. Each strap has a pair of opposing ends. Each end of each strap is detachably couplable to the perimeter side wall of the sole member the such that the inner surfaces of the straps face the sole member.

4 Claims, 2 Drawing Sheets

FIG. 3
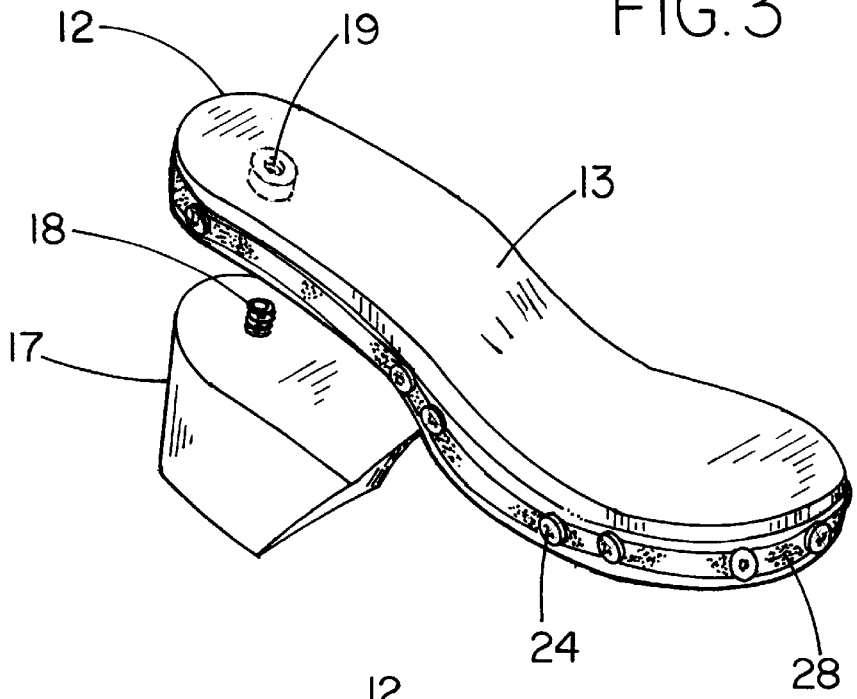
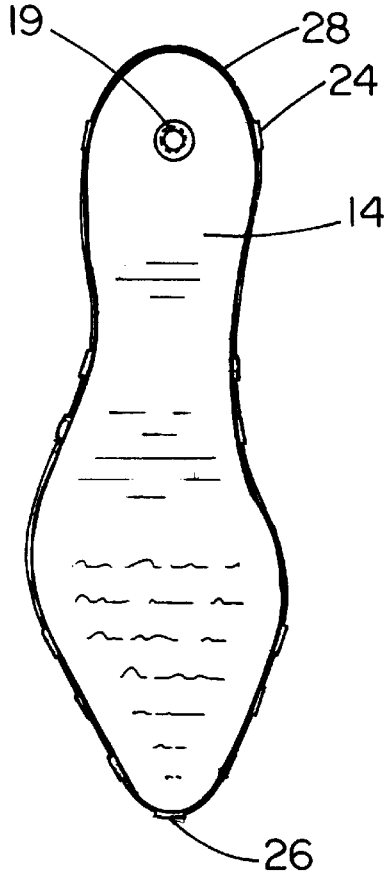
FIG. 4
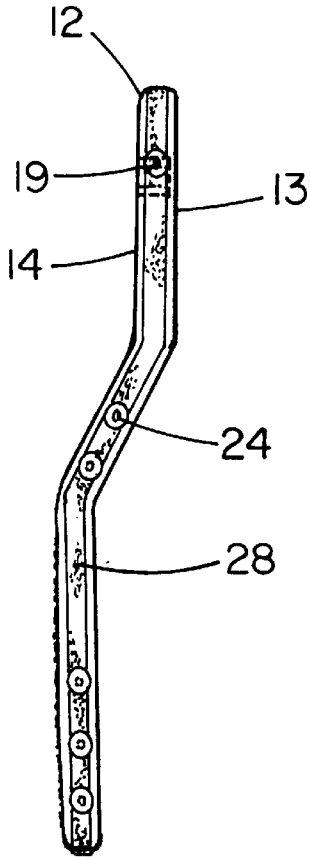
FIG. 5

DETACHABLE SHOE STRAP SYSTEM

BACKGROUND OF THE INVENTION

1. Field of the Invention

The present invention relates to shoe devices and more particularly pertains to a new detachable shoe strap system for providing an assortment of easily interchangeable styles of footwear in a single system.

1. Description of the Prior Art

The use of shoe devices is known in the prior art. More specifically, shoe devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art shoe devices include U.S. Pat. No. 3,994,080; U.S. Pat. No. 4,439,935; U.S. Pat. No. 5,065,531; U.S. Pat. No. 4,461,102; U.S. Pat. No. Des. 270,680; and U.S. Pat. No. 5,083,385.

While these devices fulfill their respective, particular objectives and requirements, the aforementioned patents do not disclose a new detachable shoe strap system. The inventive device includes a sole member having upper and lower surfaces, and a perimeter side wall extending around the perimeter of the sole member between the upper and lower surfaces of the sole member. A heel is detachably coupled to the lower surface of the sole member and is located towards the heel end of the sole member. The system includes a plurality of flexible straps. Each strap has a pair of opposing ends. Each end of each strap is detachably couplable to the perimeter side wall of the sole member the such that the inner surfaces of the straps face the sole member.

In these respects, the detachable shoe strap system according to the present invention substantially departs from the conventional concepts and designs of the prior art, and in so doing provides an apparatus primarily developed for the purpose of providing an assortment of easily interchangeable styles of footwear in a single system.

SUMMARY OF THE INVENTION

In view of the foregoing disadvantages inherent in the known types of shoe devices now present in the prior art, the present invention provides a new detachable shoe strap system construction wherein the same can be utilized for providing an assortment of easily interchangeable styles of footwear in a single system.

The general purpose of the present invention, which will be described subsequently in greater detail, is to provide a new detachable shoe strap system apparatus and method which has many of the advantages of the shoe devices mentioned heretofore and many novel features that result in a new detachable shoe strap system which is not anticipated, rendered obvious, suggested, or even implied by any of the prior art shoe devices, either alone or in any combination thereof.

To attain this, the present invention generally comprises a sole member having upper and lower surfaces, and a perimeter side wall extending around the perimeter of the sole member between the upper and lower surfaces of the sole member. A heel is detachably coupled to the lower surface of the sole member and is located towards the heel end of the sole member. The system includes a plurality of flexible straps. Each strap has a pair of opposing ends. Each end of each strap is detachably couplable to the perimeter side wall of the sole member the such that the inner surfaces of the straps face the sole member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new detachable shoe strap system apparatus and method which has many of the advantages of the shoe devices mentioned heretofore and many novel features that result in a new detachable shoe strap system which is not anticipated, rendered obvious, suggested, or even implied by any of the prior art shoe devices, either alone or in any combination thereof.

It is another object of the present invention to provide a new detachable shoe strap system which may be easily and efficiently manufactured and marketed.

It is a further object of the present invention to provide a new detachable shoe strap system which is of a durable and reliable construction.

An even further object of the present invention is to provide a new detachable shoe strap system which is susceptible of a low cost of manufacture with regard to both materials and labor, and which accordingly is then susceptible of low prices of sale to the consuming public, thereby making such detachable shoe strap system economically available to the buying public.

Still yet another object of the present invention is to provide a new detachable shoe strap system which provides in the apparatuses and methods of the prior art some of the advantages thereof, while simultaneously overcoming some of the disadvantages normally associated therewith.

Still another object of the present invention is to provide a new detachable shoe strap system for providing an assortment of easily interchangeable styles of footwear in a single system.

Yet another object of the present invention is to provide a new detachable shoe strap system which includes a sole member having upper and lower surfaces, and a perimeter side wall extending around the perimeter of the sole member between the upper and lower surfaces of the sole member. A heel is detachably coupled to the lower surface of the sole member and is located towards the heel end of the sole member. The system includes a plurality of flexible straps. Each strap has a pair of opposing ends. Each end of each strap is detachably couplable to the perimeter side wall of the sole member the such that the inner surfaces of the straps face the sole member.

Still yet another object of the present invention is to provide a new detachable shoe strap system that allows a wearer to conveniently change the style of the shoe as they desire.

Even still another object of the present invention is to provide a new detachable shoe strap system that allows a user to change the style of their upper of their shoes to custom fit their needs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective view of the sole member and heel of the present invention.

FIG. 4 is a schematic lower side view of the sole member of the present invention.

FIG. 5 is a schematic side view of the sole member of the present invention.

DESCRIPTION OF THE PREFERRED EMBODIMENT

Figure 1:
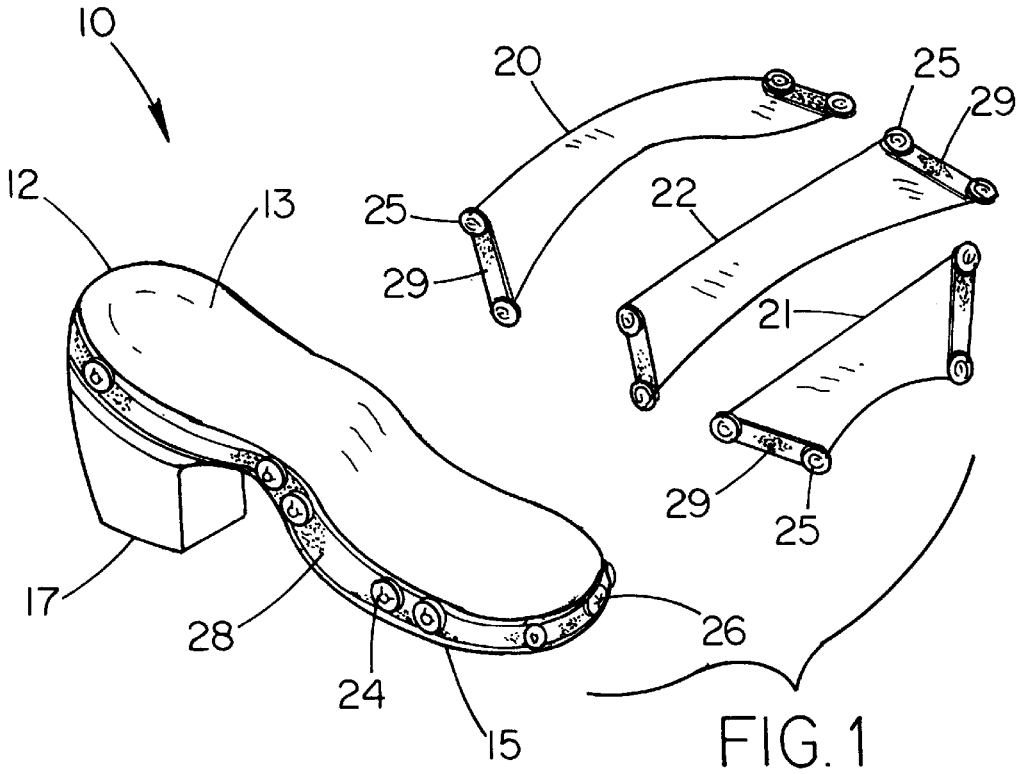
FIG. 1 is a schematic perspective view of a new detachable shoe strap system according to the present invention.
Figure 2:
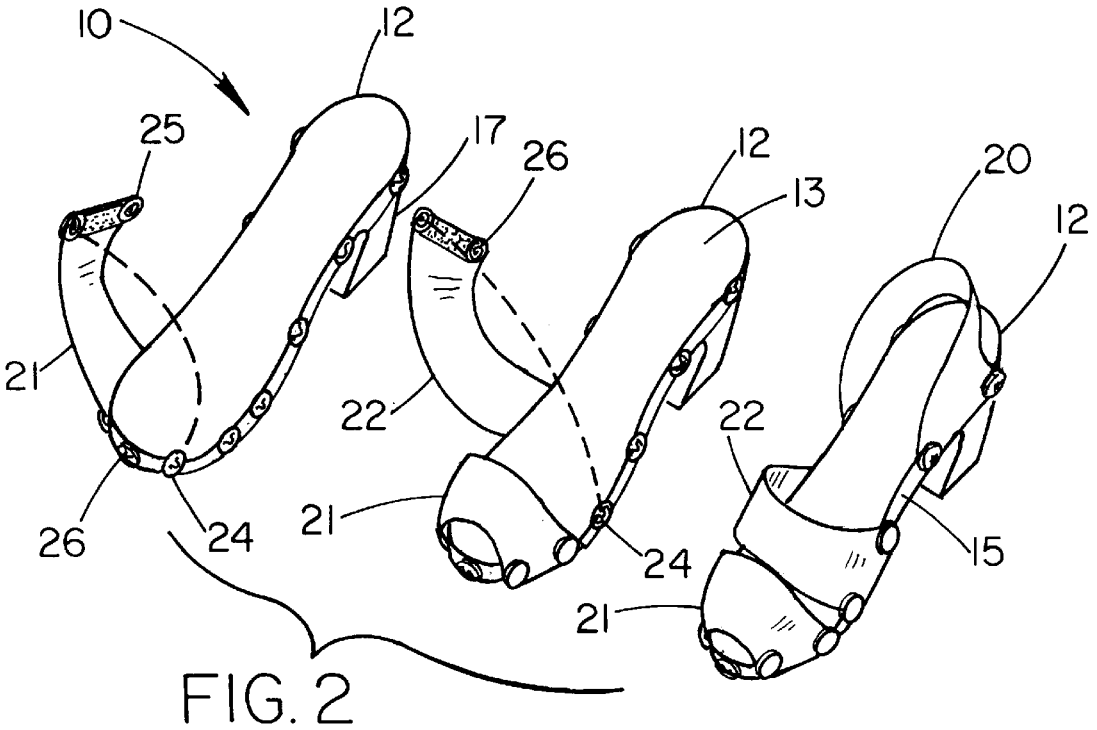
FIG. 2 is a schematic view of the present invention showing the attachment of the straps to the sole member.

With reference now to the drawings, and in particular to FIGS. 1 through 5 thereof, a new detachable shoe strap system embodying the principles and concepts of the present invention and generally designated by the reference numeral 10 will be described.

As best illustrated in FIGS. 1 through 5, the detachable shoe strap system 10 generally comprises a sole member 12 having upper and lower surfaces 13,14, and a perimeter side wall 15 extending around the perimeter of the sole member 12 between the upper and lower surfaces 13,14 of the sole member 12. A heel 17 is detachably coupled to the lower surface 14 of the sole member 12 and is located towards the heel 17 end of the sole member 12. The system 10 includes a plurality of flexible straps 20,21,22. Each strap 20,21,22 has a pair of opposing ends. Each end of each strap 20,21,22 is detachably couplable to the perimeter side wall 15 of the sole member 12 the such that the inner surfaces of the straps 20,21,22 face the sole member 12.

In use, the system 10 allows a user to form a number of different style uppers for a shoe to suit the particular needs of the user. In closer detail, the sole member 12 has opposite heel and toe ends and a pair of opposite sides. The sole member also has upper and lower surfaces 13,14. The upper surface 13 is designed for resting a foot thereon while the lower surface 14 is designed for engaging a ground surface. A perimeter side wall 15 extends around the perimeter of the sole member 12 between the upper and lower surfaces 13,14 of the sole member 12.

Preferably, a heel 17 is detachably coupled to the lower surface 14 of the sole member 12. The heel 17 is preferably located towards the heel end of the sole member 12. The detachable heel 17 is designed for allowing quick and easy changing of heels 17 by a user. Ideally, the heel 17 has a threaded bolt 18 extending therefrom which is threadably insertable into a threaded hole 19 in the lower surface 14 of the sole member 12 and positioned towards the heel 17 end of the sole member 12 to couple the heel to the sole member.

The system also includes a plurality of flexible straps 20,21,23. Each strap has inner and outer surfaces and a pair of opposing ends. Each end of each strap 20,21,23 is detachably couplable to the perimeter side wall 15 of the sole member 12 the such that the inner surfaces of the straps 20,21,23 face the sole member 12. In use, the straps 20,21,23 may be made into any appropriate size and shape. For example, the straps may include a slingback or heel strap 20, a toe region strap 21, and an arch region strap 22.

Preferably, a plurality of fasteners detachably couple the ends of the straps 20,21,22 to the perimeter side wall 15 of the sole member 12. In the preferred embodiment, the fasteners comprise snap fasteners. Preferably, each snap fastener has separable first and second portions 24,25. Each first portion 24 of the snap fasteners is detachably attachable to its associated second portion 25 of the snap fasteners. The first portions 24 of the snap fasteners are coupled to the perimeter side wall 15 of the sole member 12 while each of the second portions 25 of the snap fasteners is coupled to the inner surface of an associated strap 20,21,22 adjacent the ends of their associated strap.

Ideally, a number of the first portions 24 of the snap fasteners are located on the perimeter side wall 15 of the sole member 12 at the sides of the sole member 12. In this ideal embodiment, it is preferred that at least one of the first portions 26 of the snap fasteners is located on the perimeter side wall 15 of the sole member 12 at the toe end of the sole member 12.

In the preferred embodiment, the fasteners further comprise a hook and loop fastener. The hook and look fastener is designed for further helping secure the straps 20,21,22 to the sole member 12. The hook and loop fastener has complementary first and second portions 28,29. The first portion 28 of the hook and loop fastener is extended generally along, or around, the perimeter side wall 15 of the sole member 12 and coupled to the perimeter side wall 15 of the sole member 12. Each of the ends of each of the straps 20,21,22 has a second portion 29 of the hook and loop fastener provided on their respective. The first portion 28 of the hook and loop fastener on the perimeter side wall 15 is detachably attachable to the complementary second portions 29 of the hook and loop fastener on the straps 20,21,22. Ideally, the height of the first portion 28 of the hook and loop fastener extends on the perimeter side wall 15 between the upper and lower surfaces 13,14 of the sole member 12 from just adjacent the upper surface 13 to just bellow the first portion 28 of the snap fastener on the perimeter side wall 15.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoe system, comprising:

a sole member having opposite heel and toe ends, a pair of opposite sides, upper and lower surfaces, and a perimeter side wall extending around the perimeter of said sole member and interposed between said upper and lower surfaces of said sole member;

a heel being detachably coupled to said lower surface of said sole member and being located towards said heel end of said sole member; and a plurality of flexible straps, each said strap having inner and outer surfaces and a pair of opposing ends, a plurality of fasteners including a hook and loop fastener and a plurality of snap fasteners;

said hook and loop fastener comprising complementary first and second portions detachably attachable to one another;

said first portion of said hook and loop fastener provided in an elongate strip coupled to and extending around said perimeter side wall of said sole member;

said ends of said straps each having a strip of said second portion of said hook and loop fastener provided on said inner surface of the respective strap;

each snap fastener comprising separable first and second portions detachably attachable to one another;

said first portions of said snap fasteners being coupled to said elongate strip of said first portion of said hook and loop fastener;

said first portions of said snap fasteners being arranged on said elongate strip of said first portion of said hook and loop fastener in a spaced apart row extending along said perimeter side wall of said sole member such that a region of said elongate strip of said first portion of said hook and loop fastener is exposed and extended between each pair of adjacent pair of first portions of said snap fasteners; and said ends of said straps each having a spaced apart pair of second portions of said snap fasteners coupled thereto such that the associated strip of the second portion of the hook and loop fastener of the respective end of each strap is interposed between the associated spaced apart pair of second portions of said snap fasteners.

2. The shoe system of claim 1, wherein at least one of said first portions of said snap fasteners is located on said perimeter side wall of said sole member at said toe end of said sole member.

3. The shoe system of claim 1, wherein said heel has an upper face, wherein said upper face of said heel has a threaded bolt upwardly extending therefrom, wherein said lower surface of said sole member has a threaded bore therein adjacent said heel end of said sole member, and wherein said threaded bolt being threadably inserted into said threaded bore to detachably couple said heel to said sole member.

4. A shoe system, comprising:

a sole member having opposite heel and toe ends, a pair of opposite sides, upper and lower surfaces, and a perimeter side wall extending around the perimeter of said sole member and interposed between said upper and lower surfaces of said sole member;

a heel having an upper face, said upper face of said heel having a threaded bolt upwardly extending therefrom;

said lower surface of said sole member having a threaded bore therein adjacent said heel end of said sole member;

said threaded bolt being threadably inserted into said threaded bore to detachably couple said heel to said sole member;

a plurality of flexible straps, each said strap having inner and outer surfaces and a pair of opposing ends, each end of each of said straps being detachably couplable to said perimeter side wall of said sole member such that said inner surfaces of said straps face said sole member;

wherein a plurality of fasteners detachably couple said ends of said straps to said perimeter side wall of said sole member, wherein said fasteners comprise snap fasteners, wherein said fasteners further comprise hook and loop fasteners;

a plurality of fasteners including a hook and loop fastener and a plurality of snap fasteners;

said hook and loop fastener comprising complementary first and second portions detachably attachable to one another;

said first portion of said hook and loop fastener provided in an elongate strip coupled to and extending around said perimeter side wall of said sole member;

said ends of said straps each having a strip of said second portion of said hook and loop fastener provided on said inner surface of the respective strap;

each snap fastener comprising separable first and second portions detachably attachable to one another;

said first portions of said snap fasteners being coupled to said elongate strip of said first portion of said hook and loop fastener;

said first portions of said snap fasteners being arranged on said elongate strip of said first portion of said hook and loop fastener in a spaced apart row extending along said perimeter side wall of said sole member such that a region of said elongate strip of said first portion of said hook and loop fastener is exposed and extended between each pair of adjacent pair of first portions of said snap fasteners;

said ends of said straps each having a spaced apart pair of second portions of said snap fasteners coupled thereto such that the associated strip of the second portion of the hook and loop fastener of the respective end of each strap is interposed between the associated spaced apart pair of second portions of said snap fasteners, wherein at least one of said first portions of said snap fasteners is located on said perimeter side wall of said sole member at said toe end of said sole member.

* * * * *